US008308021B2

(12) United States Patent
Turvey et al.

(10) Patent No.: US 8,308,021 B2
(45) Date of Patent: Nov. 13, 2012

(54) DISPOSABLE STORAGE CONTAINER

(75) Inventors: Robert R. Turvey, Sanford, MI (US); Nancy F. Dewane, Waterford, WI (US); Brian A. Czech, Allen Park, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 32 days.

(21) Appl. No.: 12/805,664

(22) Filed: Aug. 12, 2010

(65) Prior Publication Data

US 2012/0037652 A1 Feb. 16, 2012

(51) Int. Cl.
*B65D 41/16* (2006.01)
*B65D 41/18* (2006.01)

(52) U.S. Cl. ..... 220/793; 220/780

(58) Field of Classification Search ..... 220/793, 220/780, 781
See application file for complete search history.

(56) References Cited

U.S. PATENT DOCUMENTS

| | | | | |
|---|---|---|---|---|
| 863,721 | A | 8/1907 | Kannenberg | |
| 2,015,028 | A | 9/1935 | Gillette | |
| 3,070,275 | A | 12/1962 | Bostrom | |
| 3,397,814 | A * | 8/1968 | Zackheim | 220/792 |
| 3,421,653 | A | 1/1969 | Whaley | |
| 3,773,207 | A | 11/1973 | Dokoupil et al. | |
| 3,956,550 | A | 5/1976 | Sutch | |
| 3,973,689 | A | 8/1976 | Sutch | |
| 4,096,963 | A | 6/1978 | Rumball | |
| 4,213,537 | A | 7/1980 | Caccavale | |
| 4,238,047 | A | 12/1980 | Helms et al. | |
| 4,389,802 | A | 6/1983 | McLaren et al. | |
| 4,438,864 | A * | 3/1984 | Helms | 220/265 |
| 4,442,971 | A * | 4/1984 | Helms | 229/123.1 |
| 4,560,082 | A * | 12/1985 | Sutch | 220/270 |
| 5,054,642 | A | 10/1991 | Yoshida | |
| 5,147,591 | A | 9/1992 | Yoshida | |
| 5,592,766 | A | 1/1997 | Mygatt | |
| 5,634,567 | A | 6/1997 | Hekal | |
| 5,647,501 | A | 7/1997 | Helms | |
| 5,971,195 | A | 10/1999 | Reidinger et al. | |
| 6,053,353 | A | 4/2000 | Helms | |
| 6,311,860 | B1 | 11/2001 | Reidinger et al. | |
| 6,772,901 | B2 * | 8/2004 | Witt | 220/276 |
| 7,299,941 | B2 | 11/2007 | McMahon, III et al. | |
| 7,597,213 | B2 | 10/2009 | McDonald | |
| 7,703,626 | B2 * | 4/2010 | Witt | 220/276 |
| 2002/0074337 | A1 | 6/2002 | Melton | |
| 2004/0245261 | A1 * | 12/2004 | Stanos et al. | 220/793 |
| 2005/0115965 | A1 | 6/2005 | Gibson | |
| 2005/0252918 | A1 * | 11/2005 | McKnight et al. | 220/359.3 |
| 2006/0119000 | A1 | 6/2006 | Gibson | |
| 2006/0201946 | A1 | 9/2006 | Witt | |
| 2007/0012710 | A1 * | 1/2007 | Vovan | 220/793 |
| 2007/0090121 | A1 * | 4/2007 | Harp et al. | 220/795 |

* cited by examiner

*Primary Examiner* — Mickey Yu
*Assistant Examiner* — Niki Eloshway

(57) ABSTRACT

The invention is directed to a single use disposable storage container and a lid therefor. The container includes a base and lid. The base includes a generally inverted U-shape rim for mating with the lid to secure the lid to the container base. The container lid includes a composite of paper and plastic. The plastic portion of the lid generally includes an inverted U-shape ring for mating with the base and securing the lid to the base. The plastic ring includes a peripheral ledge and seat extending from an inner side wall of the ring. The paper center panel is secured to the peripheral ledge and seat.

7 Claims, 1 Drawing Sheet

50
18
52
50
50
16
36
36
34
32
38
36
20
40

22
20
76
24
70
26
28
66
74
30
18
32
72
69
19
34
68
14
60

20
16
18
38
20
40

12
16
20
18
40
10
64
60
60
62
66
14
60
60
62

DISPOSABLE STORAGE CONTAINER

FIELD OF INVENTION

The present invention relates to disposable storage containers and lids therefor. More particularly, the invention is directed to disposable storage containers for food and the like which include a composite lid of plastic and paper.

BACKGROUND OF THE INVENTION

Storage containers include an open top base for storage and a lid to close the base. The lid and base mate to define the closure and seal. Lightweight, disposable storage containers are known in the art.

In considering container design, price and value, and sometimes price alone, often drive the container design; the materials used; and the ultimate construction and performance of storage containers. There are often tradeoffs in the quality of the container design and the intended use of the container. Additionally, the increased cost of resin has made container design important to optimize the use of resin while concurrently providing a quality container.

Many types of storage containers are available in the marketplace, including for food storage and the like. These, containers generally fall under several categories, including (1) single use or disposable containers made of plastic or paper; (2) semi-durable containers which are disposable after a few uses; and (3) durable containers manufactured for multiple uses.

The present invention is directed to single use disposable storage containers. Most containers of this type are made of paper or plastic. When made of plastic, the plastic adds to the weight and to the cost of the container based on the price of resin. Often such containers are reused and not thrown away, in part because the container still looks new and does not suggest that it is disposable. In such instances, however, the containers designed for single use may fail and affect the freshness or other attributes of the materials stored. This may cause dissatisfaction by the consumer who has purchased the single use disposable container because it is less expensive, but then uses the container similar to a semi-durable container.

Containers having a lid of plastic and fiberboard are also generally known in the art. However, for the most part, these containers are complex, expensive to manufacture and not for single use disposable storage containers.

Container lids may also include the brand name of the storage container or decoration. With plastic containers, the product name or decoration is subject to the mold design. Accordingly, it may be difficult and/or expensive to change the container name or decoration due to the need to change the mold design.

Accordingly, there is a need in the market for a single use disposable storage container which is light-weight, attractive, and allows for the easy and inexpensive change of graphics or decoration on the lid.

SUMMARY OF INVENTION

The present invention is directed to single use disposable storage containers and lids therefor. The invention is directed to a single use container having a lid and a base. The lid is comprised of a composite of a plastic and paper. The plastic portion of the lid includes an outer ring for sealing the container and a center panel of paper. The center paper panel provides multiple advantages including reducing the weight of the container; reducing the cost of the container by use of less resin; by using less resin in the lid the lid is environmentally-friendly; by having a paper center panel the container suggests disposability of the container to the consumer so that the container is not reused thereby precluding consumer dissatisfaction if the container is reused and fails; and the paper center panel allows for different graphics and decorations and provides for the interchangeability of the graphics and decorations on the center panel.

The single use disposable storage container of the invention comprises a base and a lid. The container may be of multiple geometries and a preferred geometry is rectangular or square. The base generally includes side walls, a bottom and an open top for receiving and removing the material to be stored. The base includes a generally inverted U-shaped rim for mating with the lid to secure the lid to the container base. The container lid comprises a composite of paper and plastic. The plastic portion of the lid generally comprises an inverted U-shaped ring for mating with the base and securing the lid to the base. The plastic ring includes a peripheral ledge and seat extending from an inner side wall of the ring. The paper center panel in terms of overall size comprises a majority of the lid. The paper center panel is secured to the peripheral ledge and seat. In one preferred embodiment of the invention, the base and lid ring are injection molded from a plastic material. The paper center panel is thereafter adhered to the plastic lid by heat-sealing or bonding.

The different embodiments of the invention will be apparent from the following description of the preferred embodiments of the invention and from the accompanying drawings.

BRIEF DESCRIPTION OF THE DRAWINGS

The following detailed description of specific non-limiting embodiments of the present invention can be best understood when read in conjunction with the following drawings, where like structures are indicated with like reference numbers.

DETAILED DESCRIPTION OF THE PREFERRED EMBODIMENTS

Figure 1:
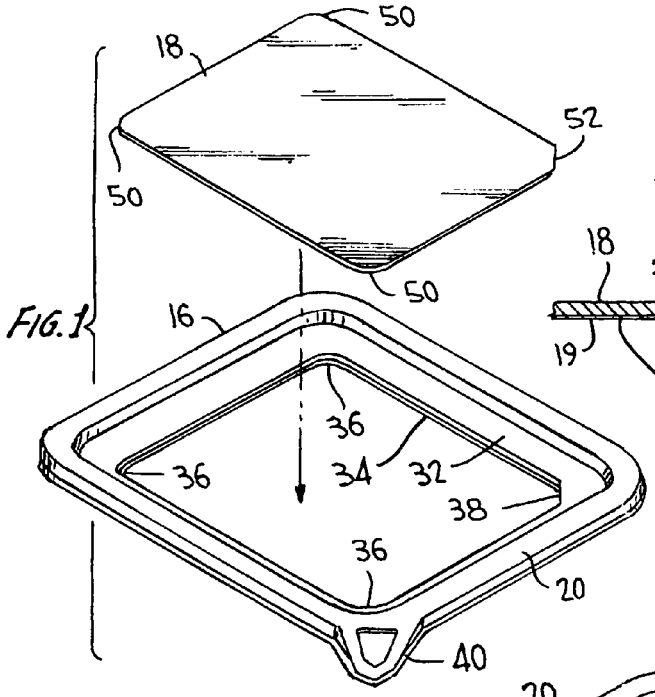
FIG. 1 is a top perspective exploded view of the lid of the present invention.
Figure 3:
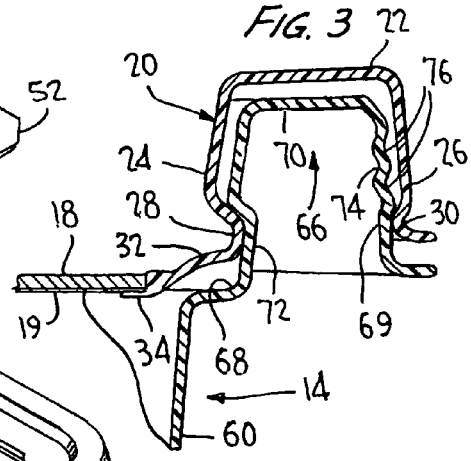
FIG. 3 is a partial cross-sectional side view of the closure of the lid and base and the composite structure of the lid.
Figure 2:
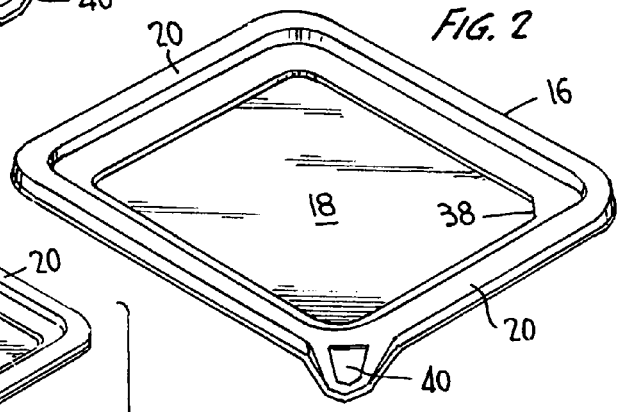
FIG. 2 is a top perspective view of the lid of FIG. 1.
Figure 4:
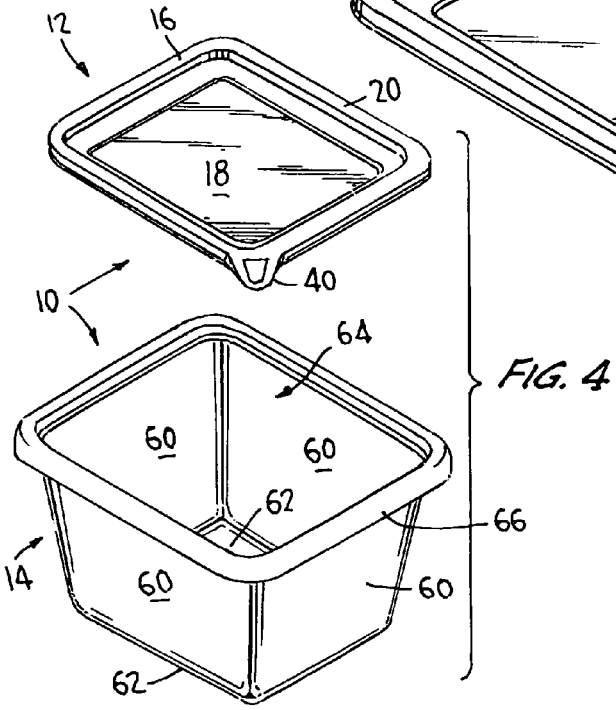
FIG. 4 is a perspective view of the storage container lid and base.

The container 10 of the invention comprises a lid 12 and base 14. The lid 12 comprises a plastic ring 16 and a center panel 18 made of paper. While the container 10 is generally shown in the drawings as rectangular, it is understood that other container geometries may be used with the invention including square, round, oval or the like.

A primary novel feature of the invention is providing a lid made of at least two different single use and disposable materials, namely plastic and paper. The lid includes ring 16 which comprises an inverted U-shape closure 20 having top wall 22, inner side wall 24 and outer side wall 26. Side walls 24 and 26 include ridges 28 and 30, respectively, for engaging the rim of base 14 for closure of the container. The ring further includes a ledge 32 spanning the circumference of ring 16 and having a seat 34 for receiving center paper panel 18. Ledge 32 includes corners 36 wherein at least one corner 38 has a different shape, in a preferred embodiment this corner is an angled shape for mating with a corresponding portion of panel 18 as discussed hereafter. The lid further includes a gripping tab 40 for opening and closing the container.

Panel 18 is made of paper designed for single use and to be disposable. Panel 18 includes corners 50 wherein at least one of corner 52 has a different shape, in a preferred embodiment the corner 52 is angled and mates with corner 38 of ring 16. This allows for proper insertion and sealing of panel 18 to ring 16 such that the graphics and/or decoration on the lid are in the correct orientation. Panel 18 further includes a coating 19 on the underside of the panel. If the panel is to be attached to ring 16 by bonding, the underside of the panel is provided with a bonding coating in at least an area sufficient to provide adhesion of panel 18 to ledge 32 and seat 34. Coatings which provide a suitable adhesive strength based on its use as described herein will be determinable by one skilled in the art. The coating further is preferably selected to protect the underside of the paper panel from the contents of the container by providing a moisture-resistant surface to the underside of the panel. The protective coating can be used when heat bonding the panel to the ring or the coating can be the same or a separate material from the adhesive coating (when used) which adheres panel 18 to ledge 32. In terms of overall size of lid 12, paper panel 18 comprises a majority of the overall size dimensions of the lid.

The container base 14 includes side walls 60, bottom wall 62, open top 64 and an inverted U-shaped lip 66. The inverted U-shaped lip 66 includes top wall 70, inner side wall 72 and outer side wall 74 which are generally constructed to mate with top and side walls 22, 24, and 26 of lid 12. Lip 66 includes grooves 68 and 44 69 for receiving ridges 28 and 30 of lid 12 to seal and close the container. Lip 66 further includes one or more ridges 76 on outer wall 74 over which ridge 30 will move when closing the container to provide an audible noise to indicate closure of the container to the consumer.

The center panel 18 may include different graphics such as the brand name of the container and/or decoration. These can be in a single or multiple colors. As previously stated, the graphics and/or decoration may appear best when oriented in relation to the gripping tab 40. Such orientation is assured by use of a different shape of the corner in the ring 16 and the panel 18, i.e. corners 38 and 52. Paper panel 18 provides for the easy and inexpensive substitution of different designed panels 18 depending on consumer preference. For example, panels 18 may be decorated for different seasons of the year to illustrate sunshine or warmth in the summer months and snowflakes or the like during the winter months. Additionally, the panel lid decoration may be illustrated for specific occasions such as the Christmas season or the 4th of July.

The container ring and container base are made of a disposable plastic. A preferred plastic is polypropylene. However, other plastics such as polyethylene, polystyrene or polyethylene terephthalate may be used. Preferably, the container ring and base are made of the same plastic, although they may be made of different plastics, e.g. the container base may be made of polyethylene and the container lid ring may be made of polypropylene. The container lid and base are made by known molding processes, such as injection molding. When manufacturing the container lid, the ring 16 is first injection molded with the plastic, e.g. polypropylene, and then the paper panel 18 is added thereto and secured by heat-sealing and/or known bonding techniques. During this process, the panel 18 is adhered to the ring 16 at seat 34 of ledge 32.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

We claim:

1. A disposable storage container having a base and a composite lid of disposable plastic and paper comprising:

a plastic base having a side wall, bottom wall, an open top for receiving and removing a material to be stored in the container and an inverted U-shaped rim, said rim having a top wall, an inner side wall and an outer side wall and constructed and arranged for mating with said lid to provide a closure for said container, a composite lid made of disposable plastic and paper comprising an inverted U-shaped plastic ring having a top wall, an inner side wall and an outer side wall, said ring constructed and arranged for mating with said rim of said base to provide a closure for said container, said ring further comprising a ledge and seat extending from said inner side wall and constructed and arranged for receiving a paper center panel, and a center panel made of disposable paper secured to said ledge and seat by heat sealing or bonding, wherein said center panel includes graphics or decoration, wherein said ledge includes a plurality of corners wherein at least one of said corners has a shape which mates with a corresponding portion of said center panel so as to provide a predetermined orientation of said center panel when received by said ring.

2. The storage container of claim 1 wherein said inner and outer side walls of said U-shaped ring include ridges and said inner and outer side walls of said inverted U-shaped rim include grooves, wherein said ridges and grooves are constructed and arranged to mate to provide a closure for said container.

3. The storage container of claim 2 wherein said outer wall of said inverted U-shaped rim includes one or more ridges, and wherein when said lid is being secured to said base, there is an audible sound created by said lid and said one or more ridges of said base.

4. The storage container of claim 1 wherein said container is rectangular or square and wherein said at least one corner of said ledge and said corresponding portion of said panel having have complementary geometries constructed and arranged to mate.

5. The storage container of claim 4 wherein said ledge includes one corner of a shape different from shapes of others of said plurality of corners of said ledge and said composite lid includes a gripping tab, wherein said gripping tab is at a corner adjacent to said one corner of said ledge.

6. The storage container of claim 1 wherein said plastic material of said lid and said base is selected from the group consisting of polyethylene, polypropylene, polystyrene and polyethylene terephthalate.

7. The storage container of claim 1 wherein said paper center panel has on an underside thereof an adhesion coating to promote said heat sealing or said bonding and provide a moisture-resistant surface to the underside of said center panel.

* * * * *